US006821058B1

(12) United States Patent
Dawson

(10) Patent No.: US 6,821,058 B1
(45) Date of Patent: Nov. 23, 2004

(54) RETAINING WALL BLOCK SYSTEM AND CONNECTOR

(75) Inventor: William B. Dawson, Medina, MN (US)

(73) Assignee: Keystone Retaining Wall Systems, Inc., Bloomington, MN (US)

( * ) Notice: Subject to any disclaimer, the term of this patent is extended or adjusted under 35 U.S.C. 154(b) by 0 days.

(21) Appl. No.: 10/603,069

(22) Filed: Jun. 24, 2003

(51) Int. Cl.[7] ..... E02D 29/00

(52) U.S. Cl. ..... 405/284; 405/286; 52/604; 52/605; 52/606

(58) Field of Search ..... 405/284, 286, 405/262, 16, 17; 52/606, 604, 607, 609, 611, 605, 608; 403/237, 238, 240, 241, 286

(56) References Cited

U.S. PATENT DOCUMENTS

| | | | | | |
|---|---|---|---|---|---|
| 1,924,724 | A | * | 8/1933 | Olney | 52/379 |
| 4,009,550 | A | * | 3/1977 | Young | 52/726.3 |
| 4,998,397 | A | * | 3/1991 | Orton | 52/715 |
| 5,881,515 | A | * | 3/1999 | George | 52/233 |
| 5,913,790 | A | * | 6/1999 | Dawson | 52/609 |
| 6,615,561 | B2 | * | 9/2003 | MacDonald et al. | 52/606 |
| 2002/0187010 | A1 | * | 12/2002 | MacDonald et al. | 405/284 |

* cited by examiner

*Primary Examiner*—Heather Shackelford
*Assistant Examiner*—Lisa M. Saldano
(74) *Attorney, Agent, or Firm*—Popovich, Wiles & O'Connell, P.A.

(57) ABSTRACT

A retaining wall system and connector therefor. The system can be used with soil reinforcement material. The connector can function to hold the reinforcement material in place in addition to interlocking the blocks together.

7 Claims, 19 Drawing Sheets

RETAINING WALL BLOCK SYSTEM AND CONNECTOR

FIELD OF THE INVENTION

The present invention relates to a retaining wall block system. The system also includes a connector that is used to interlock blocks together and/or with soil reinforcement materials, such as a geogrid.

BACKGROUND OF THE INVENTION

In recent years, segmental concrete retaining wall units which are dry stacked (i.e., built without the use of mortar) have become a widely accepted product for the construction of retaining walls. Examples of such products are described in U.S. Pat. No. Re. 34,314 (Forsberg '314) and U.S. Pat. No. 5,294,216 (Sievert). Such products have gained popularity because they are mass produced, and thus relatively inexpensive. They are structurally sound, easy and relatively inexpensive to install, and couple the durability of concrete with the attractiveness of various architectural finishes.

The retaining wall system described in Forsberg '314 has been particularly successful because of its use of a block design that includes, among other design elements, a unique pinning system that interlocks and aligns the retaining wall units, allowing structural strength and efficient rates of installation. This system has also shown considerable advantages in the construction of larger walls when combined with the use of geogrid tie-backs hooked over the pins, as described in U.S. Pat. No. 4,914,876 (Forsberg).

The construction of modular concrete retaining walls as described in Forsberg involves several steps. First, a leveling pad of dense base material or unreinforced concrete is placed, compacted and leveled. Second, the initial course of blocks is placed and leveled. Two pins are placed in each block into the pin holes. Third, core fill material, such as crushed rock, is placed in the cores of the blocks and spaces between the blocks to encourage drainage and add mass to the wall structure. Fourth, succeeding courses of the blocks are placed in a "running bond" pattern such that each block is centered over the two blocks below it. This is done by placing the blocks so that the receiving cavities of the bottom of the block fit over the pins that have been placed in the units in the course below. As each course is placed, pins are placed in the blocks, the blocks are corefilled with drainage rock, and the area behind the course is backfilled and compacted until the wall reaches the desired height.

If wall height or loading conditions require it, the wall structure may be constructed using reinforced earth techniques such as geogrid reinforcement, geosynthetic reinforcement, or the use of inextensible materials such as steel mesh or mat. The use of geogrids are described in U.S. Pat. No. 4,914,876 (Forsberg). After placement of a course of blocks to the desired height, the geogrid material is placed so that the pins in the block penetrate the apertures of the geogrid. The geogrid is then laid back into the area behind the wall and put under tension by pulling back and staking the geogrid. Backfill is placed and compacted over the geogrid, and the construction sequence continues as described above until another layer of geogrid is called for in the planned design. The use of core fill in the blocks is known to enhance the wall system's resistance to pull out of the geogrid from the wall blocks.

Though the pinning system described above can aid in producing a structurally sound wall, there is a desire to provide a block that is as lightweight as possible, relatively inexpensive and easy to produce. In addition it is desirable to have a block that connects well to geogrid reinforcement particularly in the upper section of a retaining wall where the normal load on the connection of the geogrid to the block is limited.

SUMMARY OF THE INVENTION

This invention is a retaining wall block and system that includes connectors used to align an upper course of blocks over a lower course. The block and connectors can be used with soil reinforcement materials.

In one aspect, this invention is a wall block connection system comprising a plurality of wall blocks, each wall block having a top surface, a bottom surface opposed to the top surface, first and second opposing side surfaces, a front face, and a rear face, the front and rear faces, top and bottom surfaces and side surfaces defining a block body, the block body including a head portion including the front face, a rear portion including the rear face, and first and second neck portions defining a core between the head and rear portions adjacent the rear portion, the head portion having at least one cavity defining a first web portion between the cavity and the first side surface and a second web portion between the cavity and the second side surface and a plurality of channel shaped connectors, each connector having first and second side segments connected by a bridge segment, the bridge segment having a pin element extending therefrom and being sized such that during construction of a wall, the first and second side segments straddle a web portion of the block. Each block may further comprise a partition dividing the cavity into first and second cavities. The cross-sectional shape of the pin element may be circular.

In another aspect, this invention is a retaining wall having at least a first lower course of blocks and a second upper course of blocks comprising the wall block and plurality of channel shaped connectors described above wherein the bridge segment is accommodated within the recessed region of the web portion so that the pin element extends upwardly into a cavity of a block in the upper course to thereby stabilize the relative positions of the blocks in the upper and lower courses.

In a third aspect, this invention is a method of making a retaining wall having at least a first lower course of wall blocks and a second upper course of wall blocks comprising the wall blocks and channel connectors described above, placing the wall blocks to form the first lower course of blocks, positioning the connectors on the blocks in the first course such that the first and second side segments of each connector straddle the first and second web portions and the bridge portion is accommodated within the recessed region of the first and second web portions and the pin element extends upwardly, and placing wall blocks over the first course of blocks to form the second course of wall blocks, the second course of blocks being positioned such that the cavity of each block in the second course of blocks receives an upwardly extending pin element.

BRIEF DESCRIPTION OF THE DRAWINGS

A preferred form of the present invention will now be described by way of example with reference to the accompanying drawings, wherein.

DETAILED DESCRIPTION OF THE PREFERRED EMBODIMENTS

In this application, "upper" and "lower" refer to the placement of the block in a retaining wall. The lower surface faces down, that is, it is placed such that it faces the ground. In forming a retaining wall, one row of blocks is laid down, forming a course. A second course is laid on top of the first course by positioning the lower surface of one block on the upper surface of another block.

The blocks of this invention are made of a rugged, weather resistant material, such as concrete. Other suitable materials include plastic, reinforced fibers, wood, metal and stone. In the blocks of this invention, the front face is substantially parallel to the rear face of the block. The blocks of this invention are provided with a core and one or more cavities that serve to decrease the weight of the block. The core and cavities provide for ease of construction of a retaining wall. In a preferred embodiment, the top surface of the block is provided with a recessed area. This recessed area can receive the transverse bar of a geogrid. Since this transverse bar may be thicker than the rest of the geogrid, the next course of blocks will be level. In addition, this recessed area, in conjunction with one or more cavities, is configured to receive a connector that can be used with a geogrid.

Turning now to the figures, several embodiments of the block of this invention will be described.

Figure 1A:
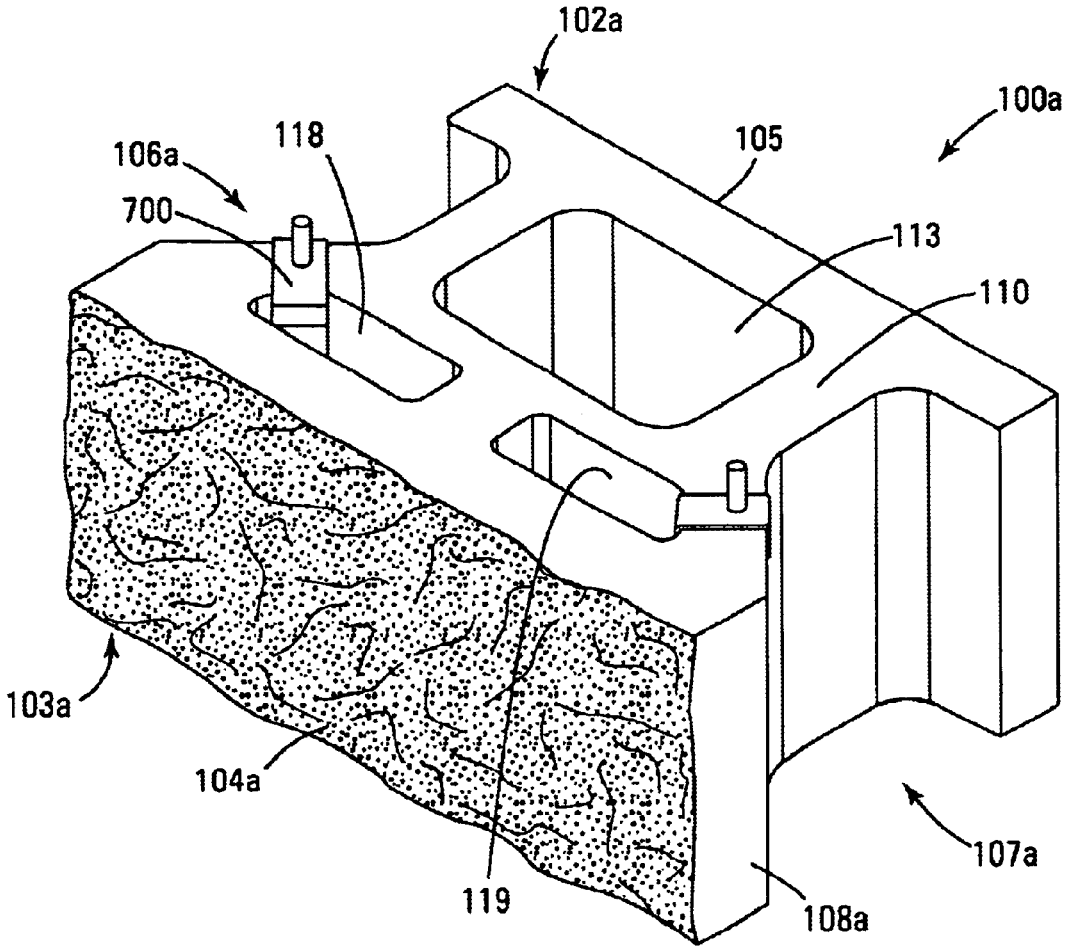
FIGS. 1A and 1B are perspective and top views, respectively, of one embodiment of the retaining wall block of this invention.
Figure 1B:
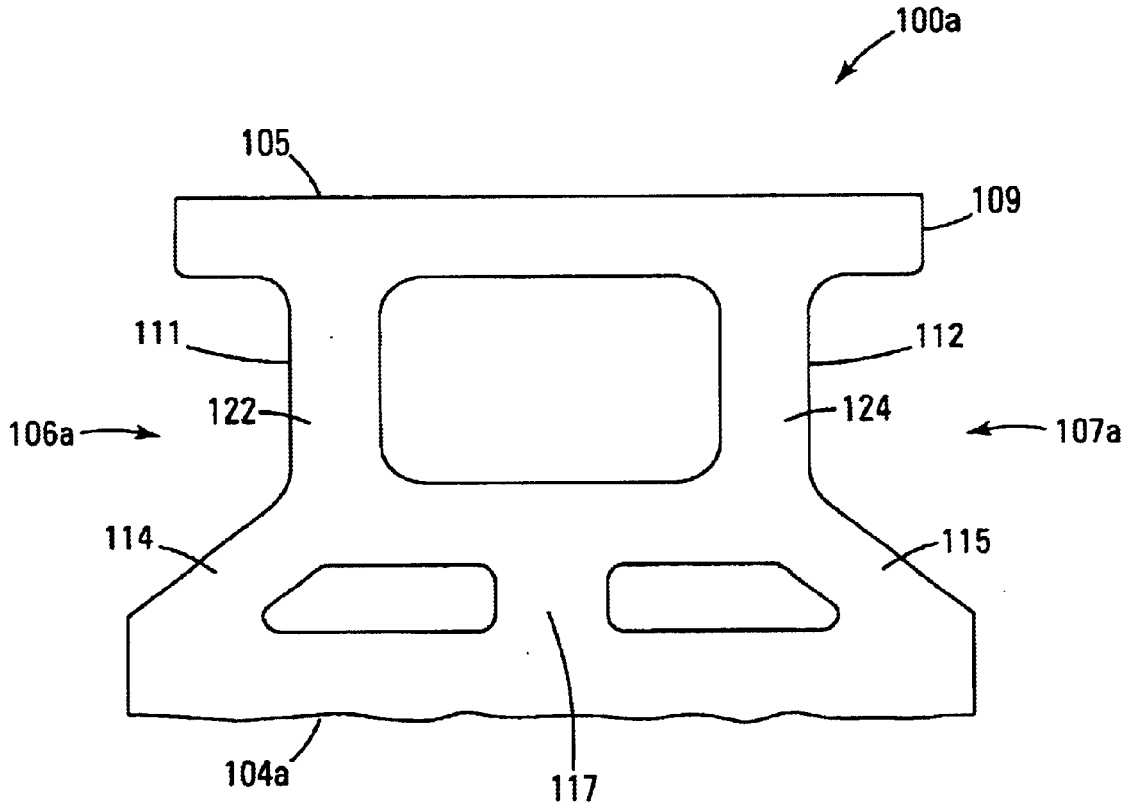

FIG. 1A illustrates block 100*a* in front perspective view and FIG. 1B shows a top view. Block 100*a* has parallel top surface 102*a* and bottom surface 103*a* (not shown), front face 104*a*, rear face 105 and first and second side wall surfaces 106*a* and 107*a*. Front face 104*a* and rear face 105 each extend from top surface 102*a* to bottom surface 103*a* and side wall surfaces 106*a*, 107*a* each extend from top surface 102*a* to bottom surface 103*a* and from front face 104*a* to rear face 105. Block 100*a* comprises body 110 which includes front portion 108*a* and back portion 109. Neck portions 122 and 124 connect front portion 108*a* and back portion 109. Front portion 108*a* includes at least one front cavity. In the preferred embodiments described herein, the front cavity is two separate cavities. In block 100*a,* cavities 118 and 119 are separated by partition 117. Partition 117 is optional, however, it provides structural stability and strength to the block. It is not required that cavities 118 and 119 extend the thickness of the block, however, it is typically preferred because of manufacturing constraints. For example, cavities 118 and 119 could be pockets or deep depressions, extending partway through the block, rather than passageways through the block. Preferably, however, the dimensions of cavities 118 and 119 are maximized so that the weight of the block is minimized. Webs 114 and 115 extend between the front cavity and side surfaces 106*a* and 107*a*, respectively.

Figure 11:
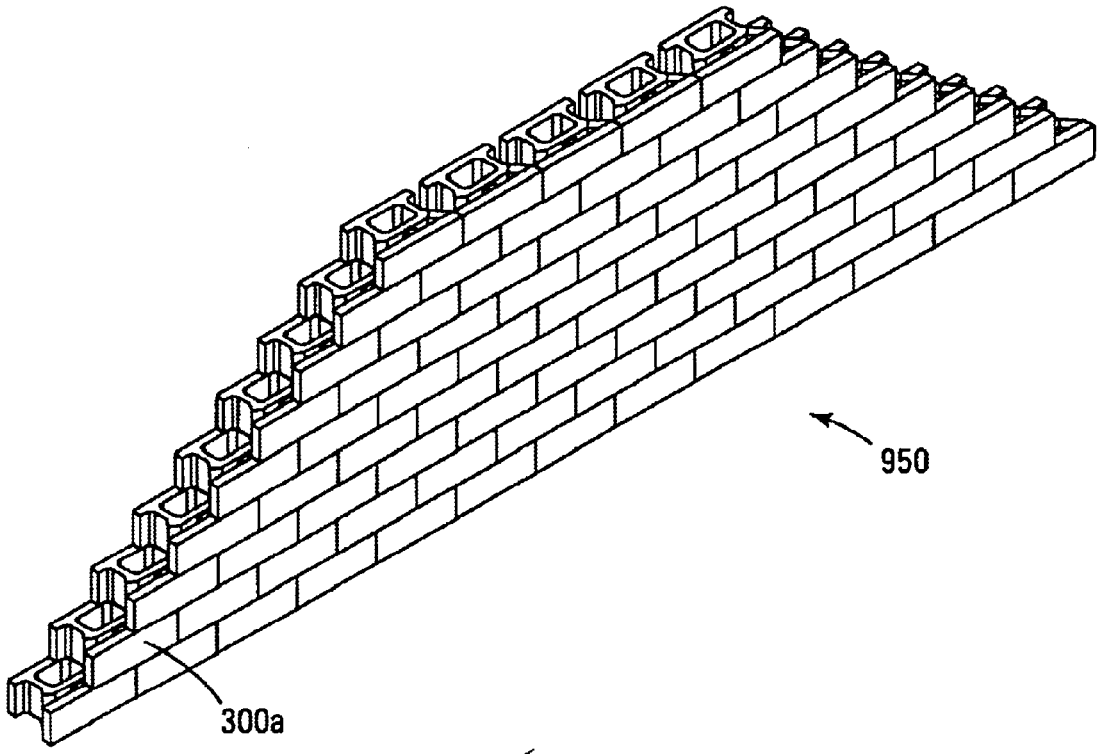
FIG. 11 is a partial perspective view of a wall in a running bond pattern constructed from the blocks of FIG. 4A.

Neck portions 122 and 124 are positioned laterally along the width of the block such that their lateral center point is spaced one-quarter of the width of the block away from the widest point of the block. This spacing allows the neck portions of each block to align with the neck portions of blocks above and below the block when a wall is built in a running bond pattern as illustrated in FIG. 11, which facilitates the passage of core fill materials such as crushed stone into the wall structure during construction, and effectively supports the vertical loads of the wall structure.

Block body 110 is provided with core 113. The block is not required to have a core, however, because the presence of a core reduces the weight of the block, a core is highly desirable. In addition, preferably the size of core 113 is maximized. A large core reduces the block's weight as much as possible and increases the blocks' connection strength to geogrids when the core is filled with core fill material (typically crushed rock). Side wall surfaces 106*a* and 107*a* extend from rear face 105 to front face 104*a* and are of a compound shape. The compound shape results in side voids 111 and 112. Such side voids are desirable in reducing the weight of the block and because they can be used to add to the stability of a wall, as described further below.

Figure 2A:
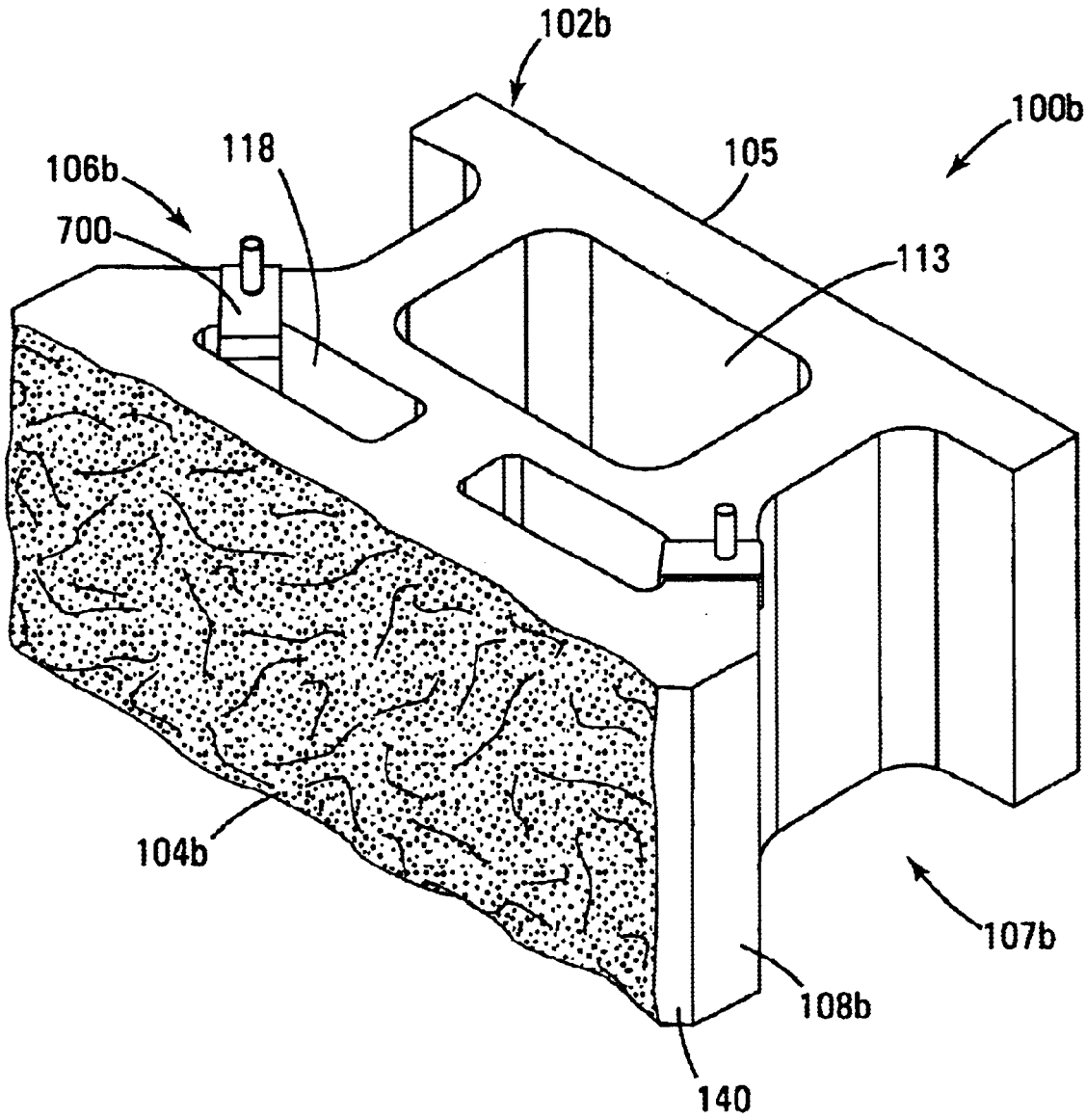
FIGS. 2A and 2B are perspective and top views, respectively, of another embodiment of the retaining wall block of this invention.
Figure 2B:
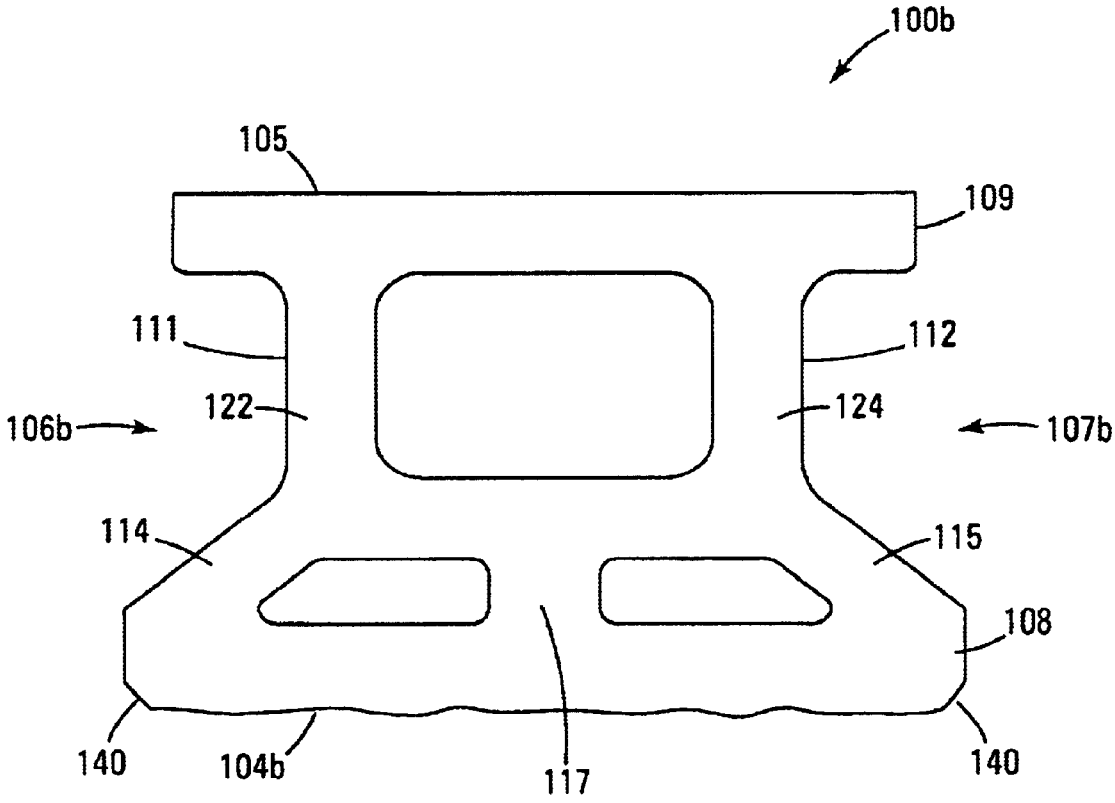

An embodiment similar to block 100*a* is block 100*b*, shown in FIGS. 2A and 2B. Identical elements have the same numbers for these two blocks. Front portion 108*b* differs from 108*a* in that there are beveled corners 140. Thus face 104*b* is smaller than face 104*a*. Block 100*b* also is shown with connector 700 in place.

In addition, saddle-shaped connector 700 is shown on blocks 100*a* and 100*b* in FIGS. 1A and 2A, respectively. This connector is described further below.

Figure 3A:
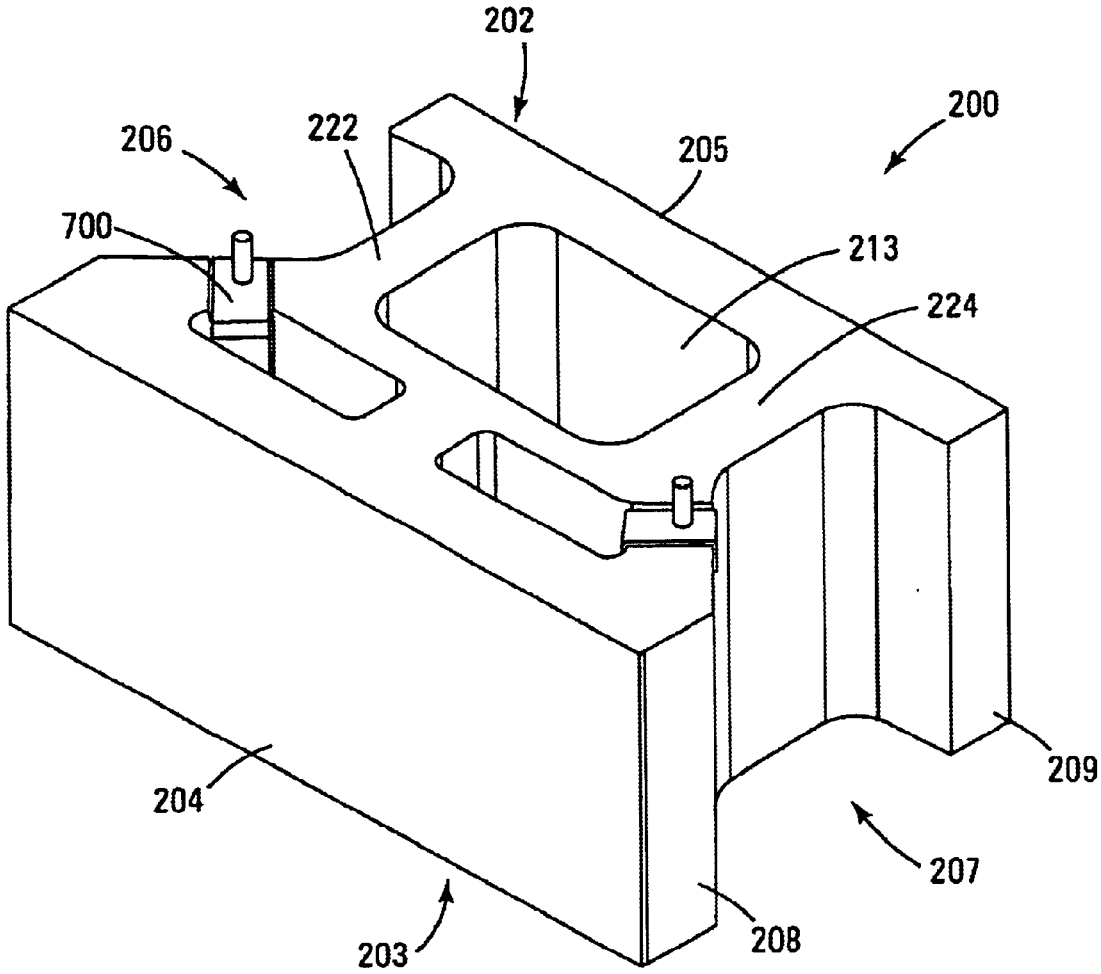
FIGS. 3A and 3B are perspective and top views, respectively, of another embodiment of the retaining wall block of this invention.
Figure 3B:
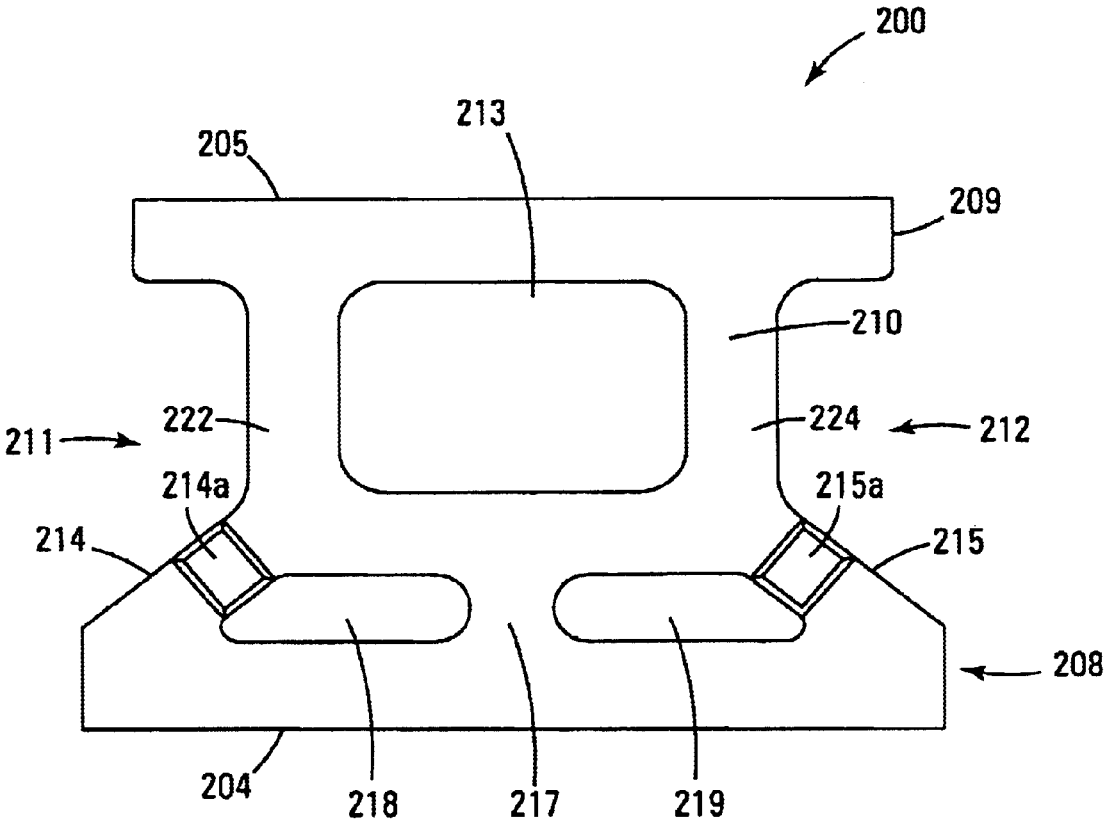
Figure 4A:
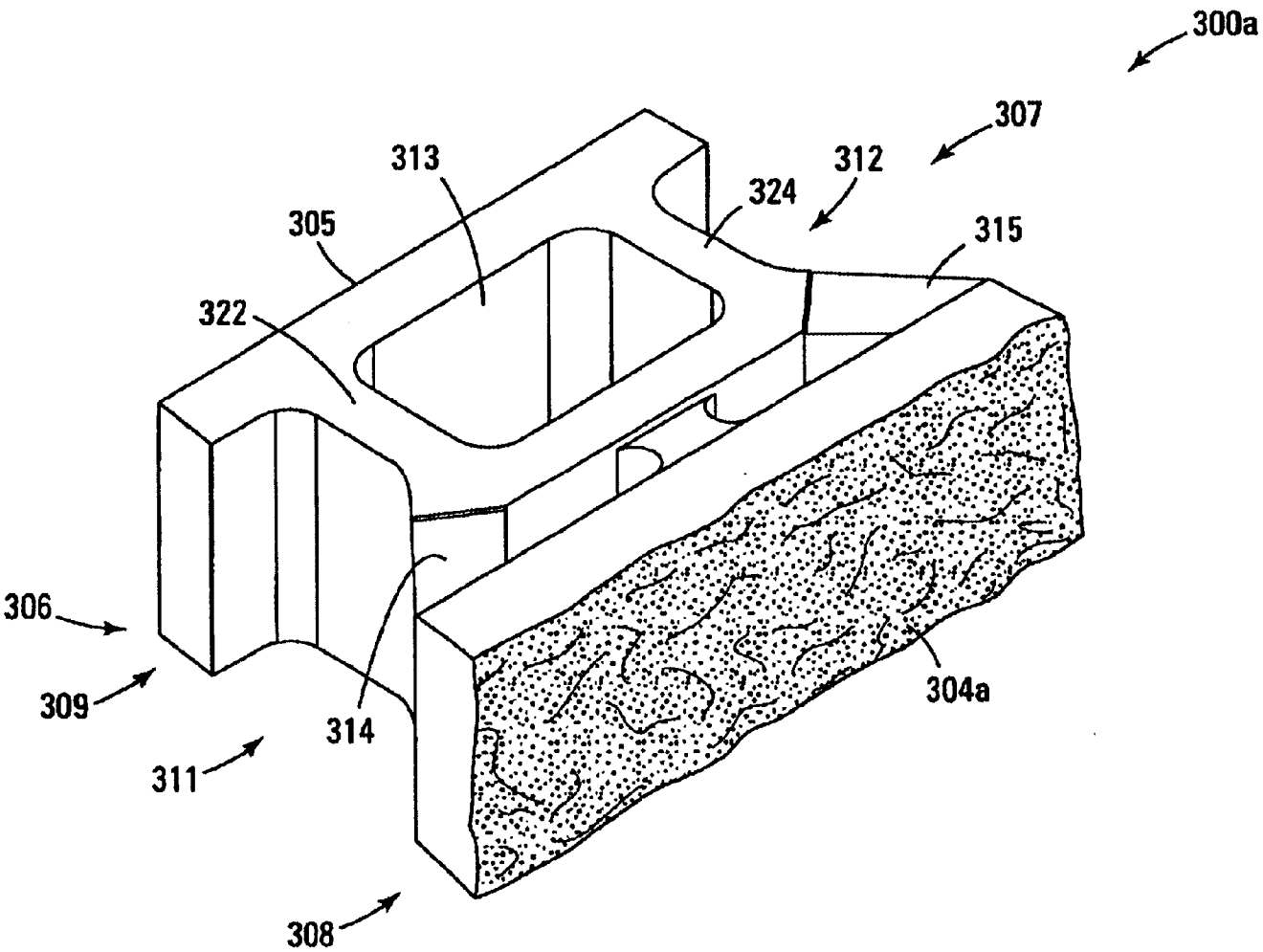
FIGS. 4A and 4B are front and back perspective views of another embodiment of the retaining wall block of this invention.
Figure 4B:
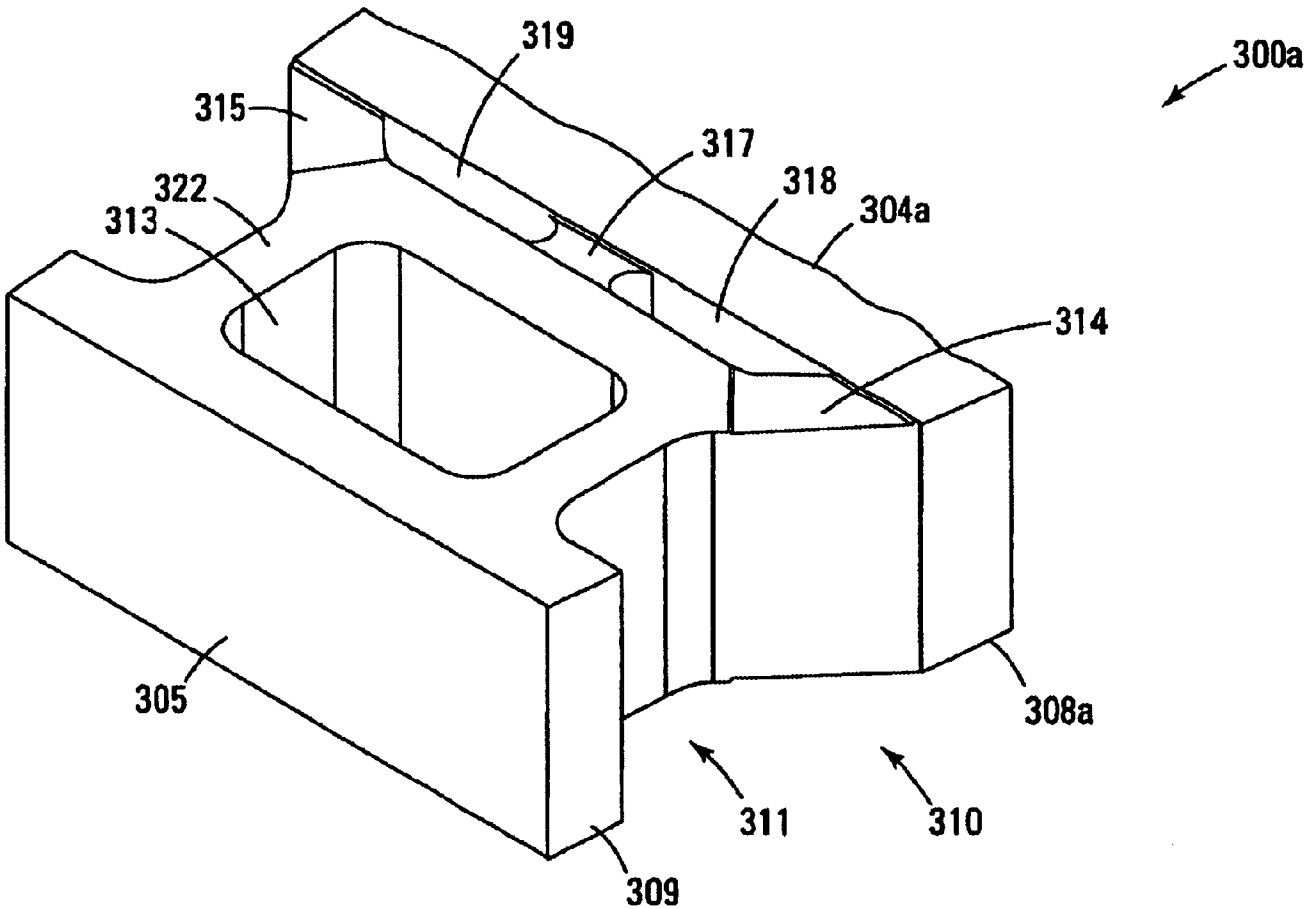

Another embodiment of the block of this invention is illustrated in FIGS. 3A and 3B wherein block 200 is shown in perspective and plan views, respectively. Block 200 is similar to block 100*a*, except that neck portions 214 and 215 have recessed areas 214*a* and 215*a*, respectively, configured to receive saddled-shaped connector 700. Connector 700 is shown in position on block 200 in FIG, 3A. Block 200 comprises body 210 which includes front portion 208, back portion 209 together with neck portions 222 and 224 connect front portion 208 and back portion 209. Partition 217 separates the front cavity into separate cavities 218 and 219. Webs 214 and 215 extend between the front cavity and side surfaces 206 and 207, respectively.

Block 200 has parallel top surface 202 and bottom surface 203, front face 204, rear face 205 and first and second side wall surfaces 206 and 207. Front face 204 and rear face 205 each extend from top surface 202 to bottom surface 203 and side wall surfaces 206, 207 each extend from top surface 202 to bottom surface 203 and from front face 204 to rear face 205. Neck portions 222 and 224 are positioned laterally along the width of the block such that their lateral center point is spaced one-quarter of the width of the block away from the widest point of the block. Front face 204 forms part of head or front portion 208, while rear face 205 forms part of back portion 209. The block body 210 is provided with core 213. Side wall surfaces 206 and 207 extend from rear face 205 to front face 204 and are of a compound shape, having side voids 211 and 212.

Block 300*a* is shown in FIGS. 4 to 7. FIGS. 4A and 4B are front and back perspective views and FIGS. 5A and 5B show top and bottom views, respectively. Block 300*a* has parallel top surface 302 and bottom surface 303, front face 304*a*, rear face 305 and first and second side wall surfaces 306 and 307. Front face 304*a* and rear face 305 each extend from top surface 302 to bottom surface 303 and side wall surfaces 306, 307 each extend from top surface 302 to bottom surface 303 and from front face 304*a* to rear face 305. As most easily seen in side view in FIGS. 6 and 7, top surface 302 has recessed area 320 extending between the side wall surfaces. Recessed area 320 can receive the transverse bar of a geogrid, as discussed below.

Block 300*a* comprises a body 310 which includes front portion 308 and back portion 309. Neck portions 322 and 324 connect front portion 308 and back portion 309. Partition 317 separates the front cavity into separate cavities 318 and 319. Partition 317 is optional, however, it provides structural stability and strength to the block. It is not required that cavities 318 and 319 extend the thickness of the block, however, it is typically preferred because of manufacturing constraints. Webs 314 and 315 extend between the front cavity and the side surfaces 306 and 307, respectively. Webs 314 and 315 and partition 317 together form recessed region 320, that is, recessed relative to top surface 302. The recessed region can be seen in cross section in, for example, FIGS. 5, 6, and 7.

In addition, front face 304*a* is provided with a desired pattern, design, or texture. For example, a roughened surface, such as the appearance of natural stone, is a desirable appearance.

Neck portions 322 and 324 are positioned laterally along the width of the block such that their lateral center point is spaced one-quarter of the width of the block away from the widest point of the block. This spacing allows the neck portions of each block to align with the neck portions of blocks above and below the block when a wall is built in a running bond pattern as illustrated in FIG. 11, which facilitates the passage of core fill materials such as crushed stone into the wall structure during construction, and effectively supports the vertical loads of the wall structure.

Front face 304 forms part of head or front portion 308, while rear face 305 forms part of back portion 309. The block body 310 is provided with core 313. The block is not required to have a core, however, because the presence of a core reduces the weight of the block, a core is highly desirable. In addition, preferably the size of core 313 is maximized. A large core reduces the block's weight as much as possible and increases the blocks' connection strength to geogrids when the core is filled with core fill material (typically crushed rock). Side wall surfaces 306 and 307 extend from rear face 305 to front face 304 and are of a compound shape. The compound shape results in side voids 311 and 312. Such side voids are desirable in reducing the weight of the block and because they can be used to add to the stability of a wall, as described further below.

Figure 5A:
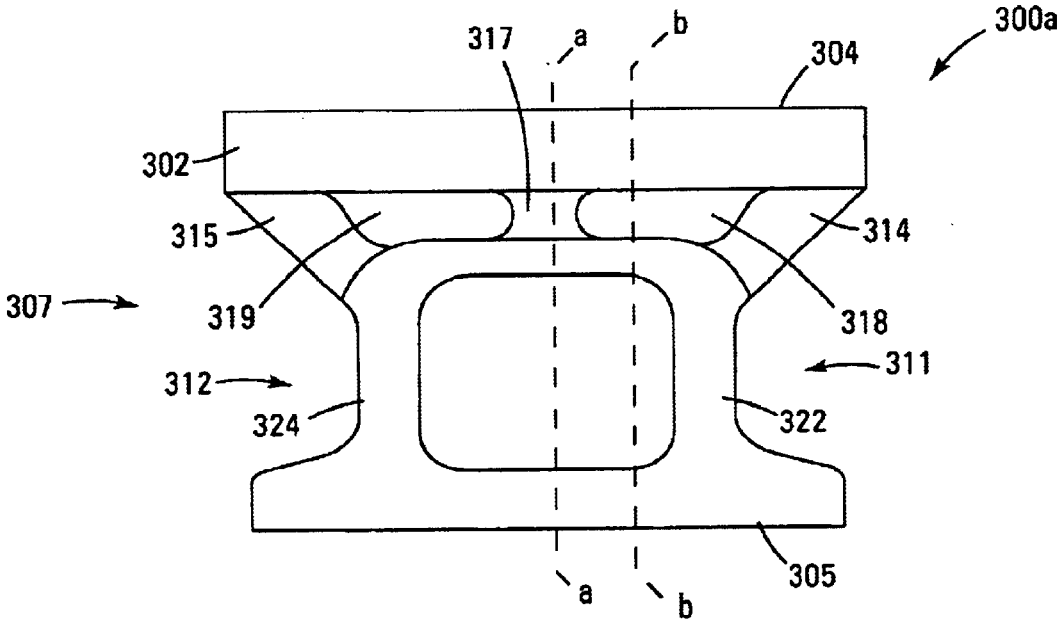
FIGS. 5A and 5B are top and bottom views, respectively, of the block shown in FIGS. 4A and 4B.
Figure 6A:
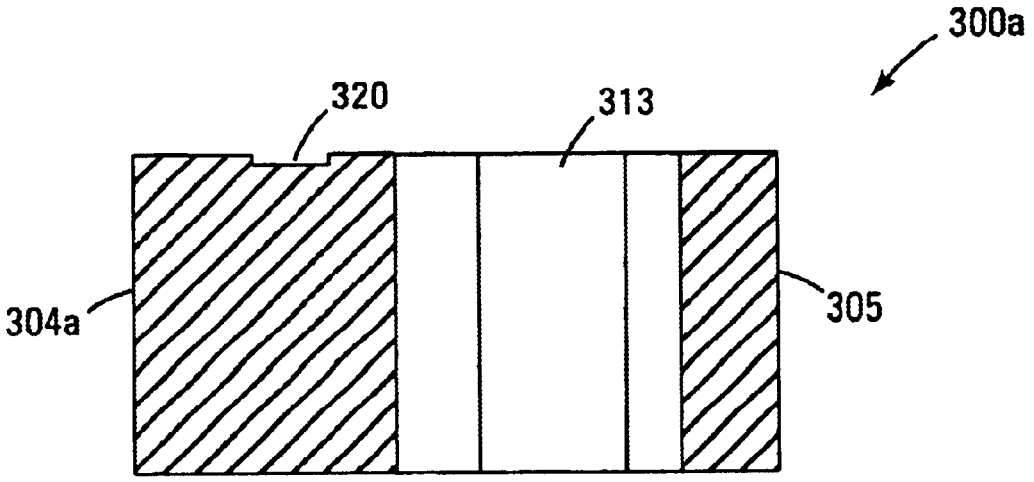
FIG. 6A is across-sectional view along line a—a of FIG. 5A
Figure 6B:
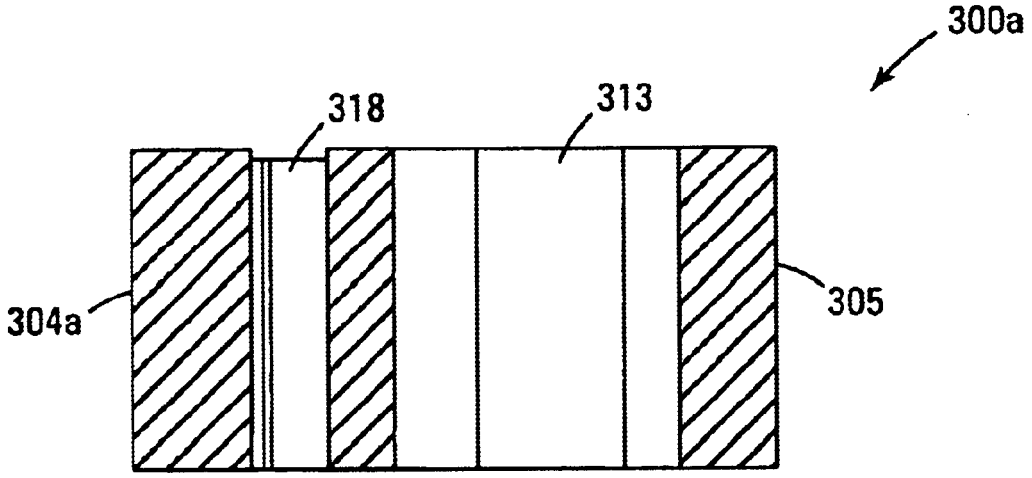
FIG. 6B is a cross-sectional view along line b—b of FIG. 6A.
Figure 7:
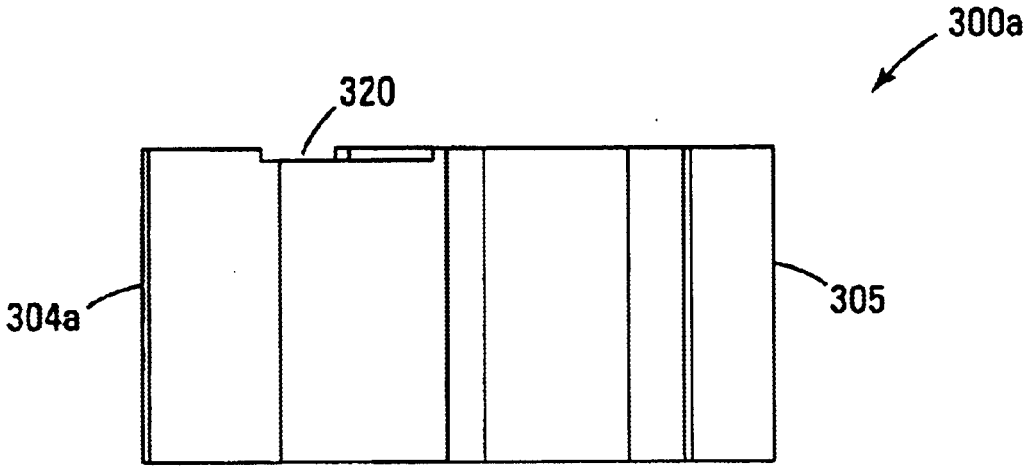
FIG. 7 is a side view of the block of FIG. 4A.

FIG. 6A is a cross-sectional view along line a—a of FIG. 5A and shows that core 313 passes from the top to the bottom of the block. Recessed area 320 is shown and discussed further below. FIG. 6B is a cross-sectional view of block 300*a* along line b—b of FIG. 5A. Cavity 318 is shown extending from the top to the bottom of the block.

Figure 5B:
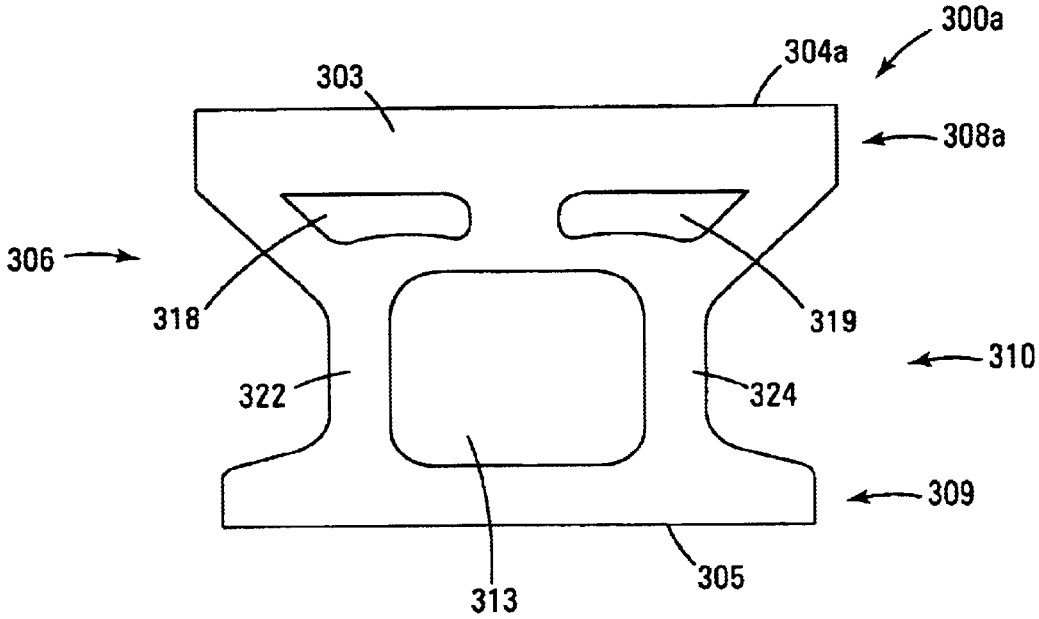

FIG. 5B shows the bottom view of block 300*a*. The bottom surface 303 of block 300*a* is substantially in one plane. FIG. 5B illustrates that the core 313 and cavities 318 and 319 pass through the block. During manufacture of the blocks, it is typical to taper the core and cavities for ease of stripping the block from the mold. That is, for example, the core is slightly larger at the top of the block than at the bottom.

Figure 8:
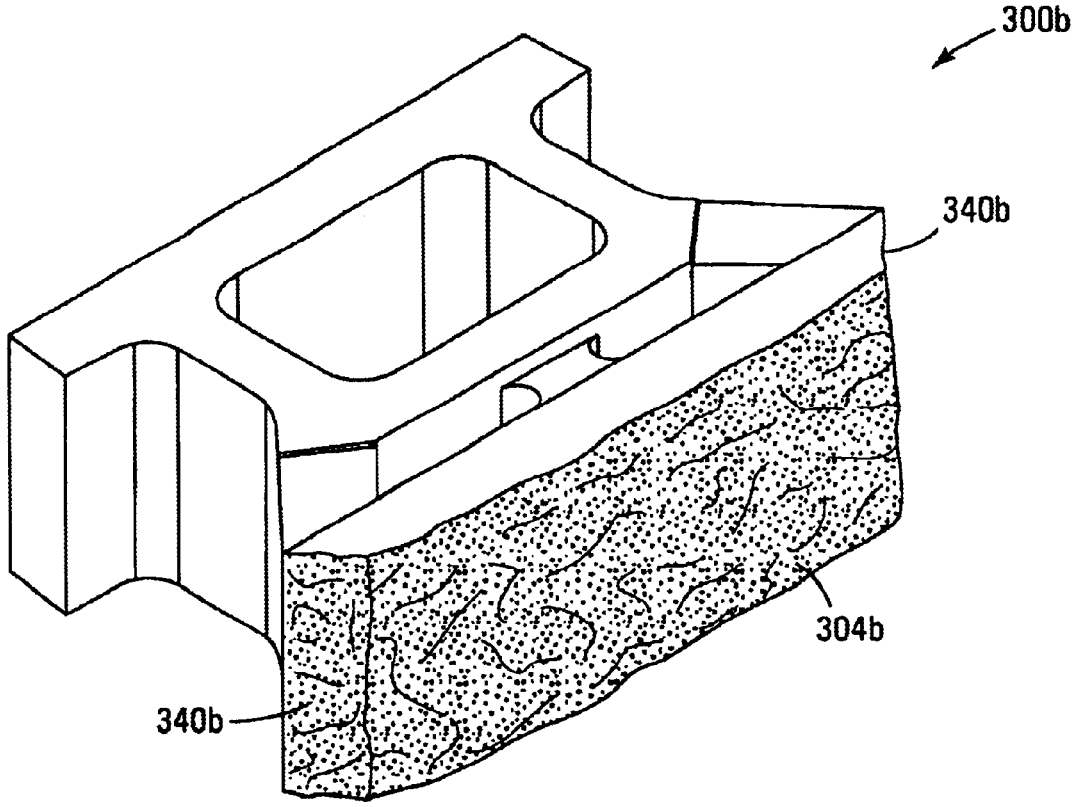
FIG. 8 is a perspective view of another embodiment of the retaining wall block of this invention.

An alternate embodiment of the block is shown in FIG. 8. Block 300*b* is substantially similar to block 300*a* except that front face 4*b* has edges 340*b* that are beveled or chamfered to provide an attractive appearance. In addition, front face 304*b* preferably is provided with a desired pattern, design, or texture. For example, a roughened surface, such as the appearance of natural stone, is a desirable appearance. The block, when made from concrete, preferably has a split or fractured front face appearance. There are several well known manufacturing techniques to accomplish this appearance.

Figure 9A:
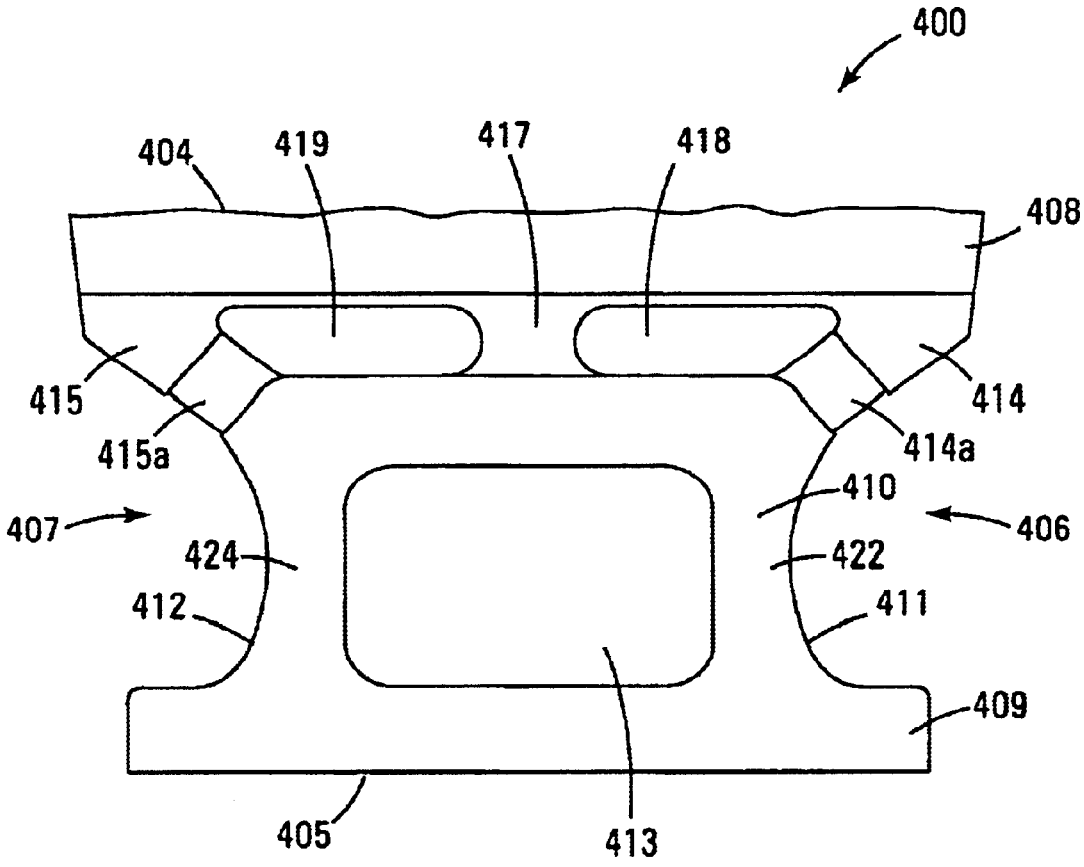
FIG. 9A is a top view of another embodiment of the retaining wall block of this invention.
Figure 9B:
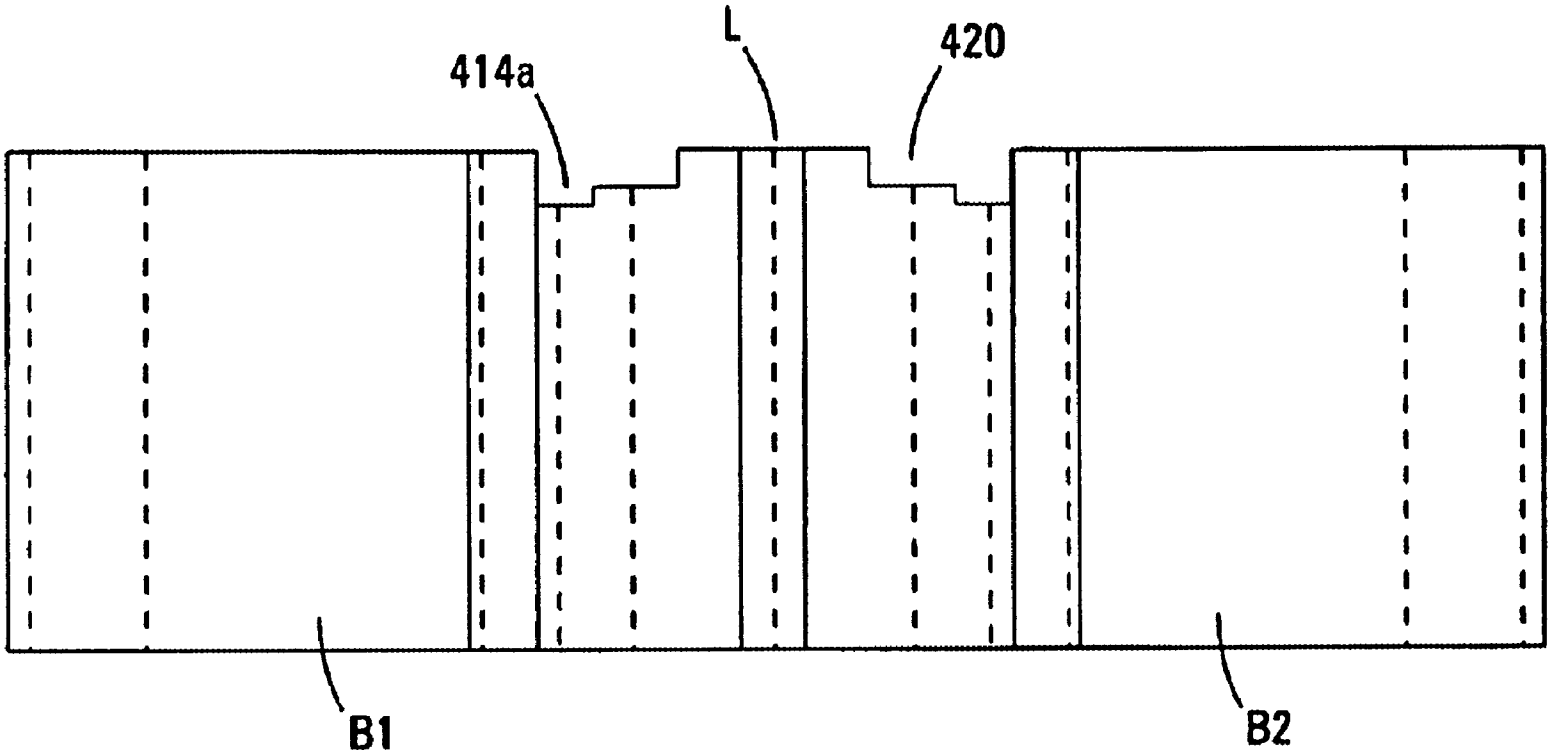
FIG. 9B is a side view of the block of FIG. 9A shown as manufactured with a companion block.
Figure 9C:
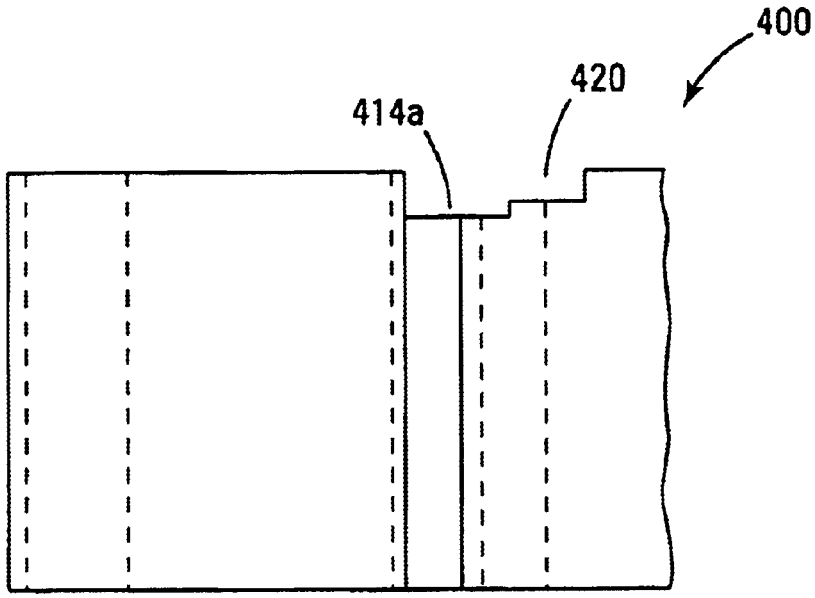
FIG. 9C is a side view of the block.
Figure 9D:
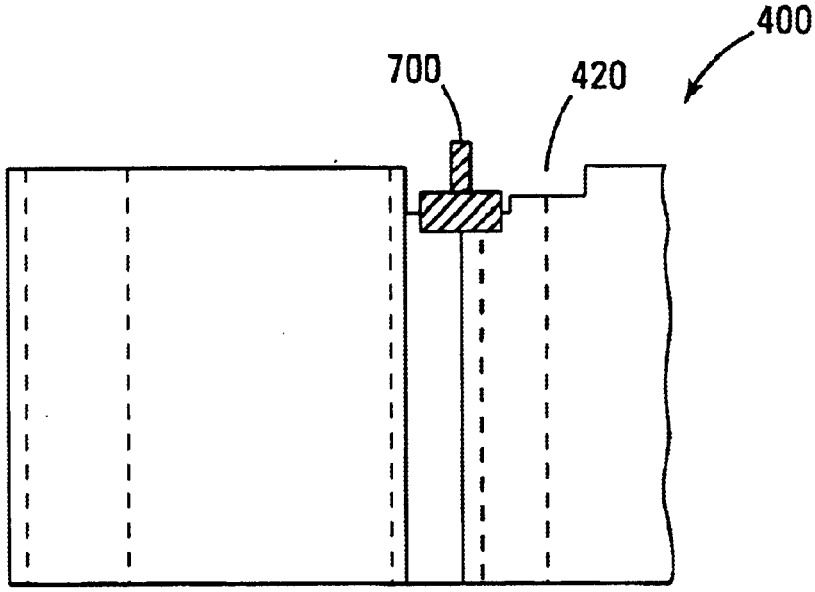
FIG. 9D is a side view of the block with a connector in place.

Another embodiment of the block of this invention is illustrated in FIGS. 9A to 9D. The top view of block 400 is shown in FIG. 9A. Block 400 comprises body 410 which includes front portion 408 and back portion 409. Neck portions 422 and 424 connect front portion 408 and back portion 409. Webs 414 and 415 extend between the front cavity and side surfaces 406 and 407, respectively.

Block 400 has parallel top surface 402 and bottom surface 403, front face 404, rear face 405 and first and second side wall surfaces 406 and 407. Front face 404 and rear face 405 each extend from top surface 402 to bottom surface 403 and side wall surfaces 406, 407 each extend from top surface 402 to bottom surface 403 and from front face 404 to rear face 405. Neck portions 422 and 424 are positioned laterally along the width of the block such that their lateral center point is spaced one-quarter of the width of the block away from the widest point of the block. Front face 404 forms part of head or front portion 408, while rear face 405 forms part of back portion 409. The block body 410 is provided with core 413. A Side wall surfaces 406 and 407 extend from rear face 405 to front face 404 and are of a compound shape, having side voids 411 and 412.

Top surface 462 has recessed area 420. This recessed area is larger than the recessed area as shown in blocks 300*a* or 300*b*, as it includes partition 417 and extends between cavities 418 and 419 and the front portion 408 of the block. Neck portions 422 and 424 connect front portion 408 and back portion 409. Webs 414 and 415 extend between the front cavity and side surfaces 406 and 407 and are provided with indentations 414*a* and 415*a*, respectively. That is, indentations 414*a* and 415*a* are recessed even deeper in the block than is recess 420. Saddle connectors 700 fit in these indentations.

The front face of the block preferably has the appearance of natural stone. One way to achieve this is to manufacture the block to have a split front face by forming two blocks together, as illustrated in a side view in FIG. 9B. Here, blocks B1 and B2 are formed in a mold and split along line L to form two identical blocks.

Though the blocks illustrated in the Figures may have various dimensions, typical dimensions of this block are about 16 to 18 inches (40.6 to 45.7 cm) wide (i.e., the width of the front face), 12 inches (30.5 cm) deep (i.e., from front face to back face), and 6 to 8 inches (15.2 cm to 20.3 cm) thick (i.e., from top to bottom surface). FIGS. 4 to 7 illustrate block 300*a* and show recessed region 320 to be about 1.37 inches (3.5 cm) wide and about 0.19 to about 0.25 inches (0.5 to 0.63 cm) deep. This region can have any desired dimension, but it has been found that this width and depth is a suitable size to receive a connector. Blocks of the present design typically will be lighter in weight per front face area than prior art blocks. A block of the present design that is 18 inches (45.7 cm) wide and 8 inches (20.3 cm) thick should weigh approximately 72 pounds (32.7 kg), and a block of 18 inches (45.7 cm) wide and 6 inches (15.2 cm) thick should weigh approximately 55 pounds (25 kg).

Figure 10A:
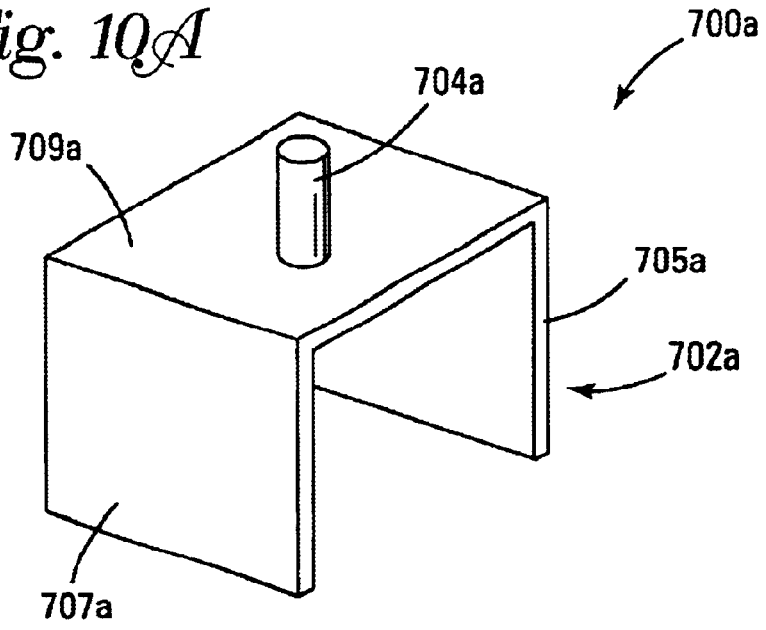
FIGS. 10A and 10B are alternate views of the connector of this invention.
Figure 10B:
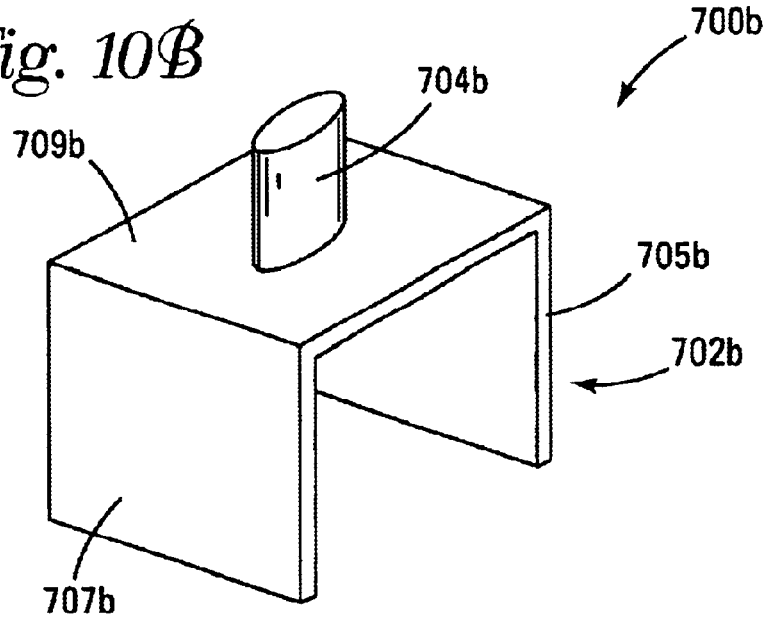

FIGS. 10A and 10B are perspective views of different embodiments of the saddle connector of this invention. Saddle connectors are used to interlock blocks in an upper course with blocks in the next lower course. Two different embodiments of saddle connectors are shown in FIGS. 10A and 10B. The placement of connectors on the blocks and their use in construction of a wall are described further below. The saddle connector illustrated in these figures is about 2 inches (5 cm) wide and fits over webs (e.g., 114 and 115). As illustrated in the Figures, the connector may be used with blocks having no recesses; however, a recessed area to accommodate the connector is preferred. Block 200 has recesses 214*a* and 215*a* designed to fit this connector. Most preferred are blocks having recessed areas such as 414*a* and 415*a* in block 400.

The connector is about 1.5 inches (3.81 cm) deep, though any desired dimension could be used, as long as the connector fits over webs (e.g., 114 and 115). The connector is about 3/16 inch (i.e., 0.187 in, 0.48 cm) thick. Connector 700 typically comprises rigid polymeric material such as polyvinyl chloride or polyethylene copolymer. It also may comprise fiberglass, steel, aluminum, or other suitable materials. Connector 700 may be formed by extruding or casting a suitable material into the desired shape. Typically, connectors of the present design are less expensive to produce than alternative, prior art connectors.

Connector 700*a* includes a channel-shaped saddle portion 702*a* and a substantially cylindrical pin element 704*a*. The pin element defines a longitudinal axis. Saddle portion 702*a* comprises support segments 705*a* and 707*a* joined by bridge segment 709*a*. The connector fits over and rests on the surface of a web (i.e., 314 and 315 of block 300 or 414 and 415 of block 400). The length and/or bias of the support segments should be sufficient to hold the connector on a web. Connector 700*b* in FIG. 10B is similar to connector 700*a* except that the shape of the pin element 704*b* is different. Saddle portion 702*b* comprises support segments 705*b* and 707*b* joined by bridge segment 709*b*. In cross section, pin element 704*a* has the shape of a circle and pin element 704*b* has the shape of an oval. Any cross-sectional shape of pin element could be used, as long as it serves to connect blocks in adjacent courses together and to attach geogrid to a wall. Also, though the pin element of FIGS. 10A and 10B is centered on bridge segment 709*a*/709*b*, the pin element could be at any location on the bridge segment.

FIG. 11 illustrates the wall 950 constructed of blocks 300*a*. The blocks are arranged in a running bond pattern wherein the shape of side voids 311 and 312 of two adjacent blocks in one course coincides with the shape of core 313 in a block in a lower course. In this way, the side voids vertically align with the cores. Also, webs 314 and 315 rest on webs of the blocks on a lower course, and neck portions 322 and 324 rest on neck portions of the blocks in a lower course, thus transferring loads evenly through the wall structure. This overlap provides continuous cavities in the wall which extends through successive courses of blocks, improving the ease with. These continuous cavities can be filled with core fill material such as crushed rock to encourage drainage and add stabilizing mass to the wall. Continuous cavities also allow for the placement of guardrail posts or fences at the top of a wall, or for the reinforcement of the wall with rebar and concrete grout.

Figure 12:
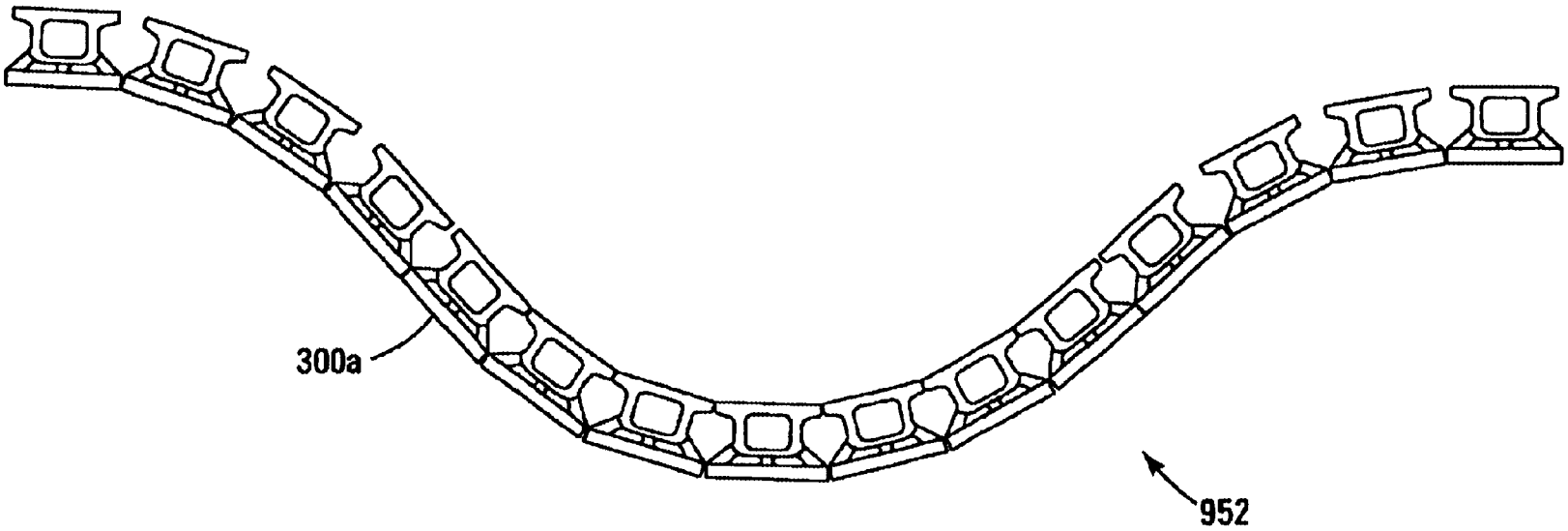
FIG. 12 is a top view of a curvilinear row of the blocks of FIG. 4A.

The blocks of this invention are designed such that free standing, straight, or curved walls can be formed. FIG. 12 is a top view of a curvilinear or serpentine row 952 of blocks 300*a* and illustrates how the shape of the block permits construction of various curves while maintaining a smooth front face of the wall. The curved walls may have both convex and concave curves, as shown in the figure.

During construction of a wall, the blocks illustrated above can be used with reinforcement materials, such as geosynthetic fabrics or relatively more rigid geogrids.

Various reinforcement materials are known in the art, and they may be inextensible, such as steel mesh, or extensible geosynthetic materials, such as mats and oriented polymeric materials. Geosynthetics are relatively flexible. Such includes rectilinear polymer constructions characterized by large (e.g., 1 inch (2.5 cm) or greater) openings. In these open structure geosynthetics, polymeric strands are woven or "welded" (by means of adhesives and/or heat) together in a grid. Polymers used for making relatively flexible geosynthetics include polyester fibers. The polyester typically is coated with a polyvinyl chloride (PVC) or a latex topcoat. The coating may contain carbon black for ultraviolet (UV) stabilization. Some open structure geosynthetics comprise polyester yarn for the warp fibers and polypropylene as the fill fibers. Another flexible reinforcing geosynthetic material is fabric, i.e., woven constructions without large openings. These fabrics typically comprise polymers and are referred to as geofabrics. The geofabric can be laid between courses of blocks in a wall, and typically is tied into the wall and held there. When blocks are configured to have pin connectors, for example, a hole or slit is formed in the geofabric at the construction site and the geofabric is held on the blocks by fitting it over the pins.

Figure 13:
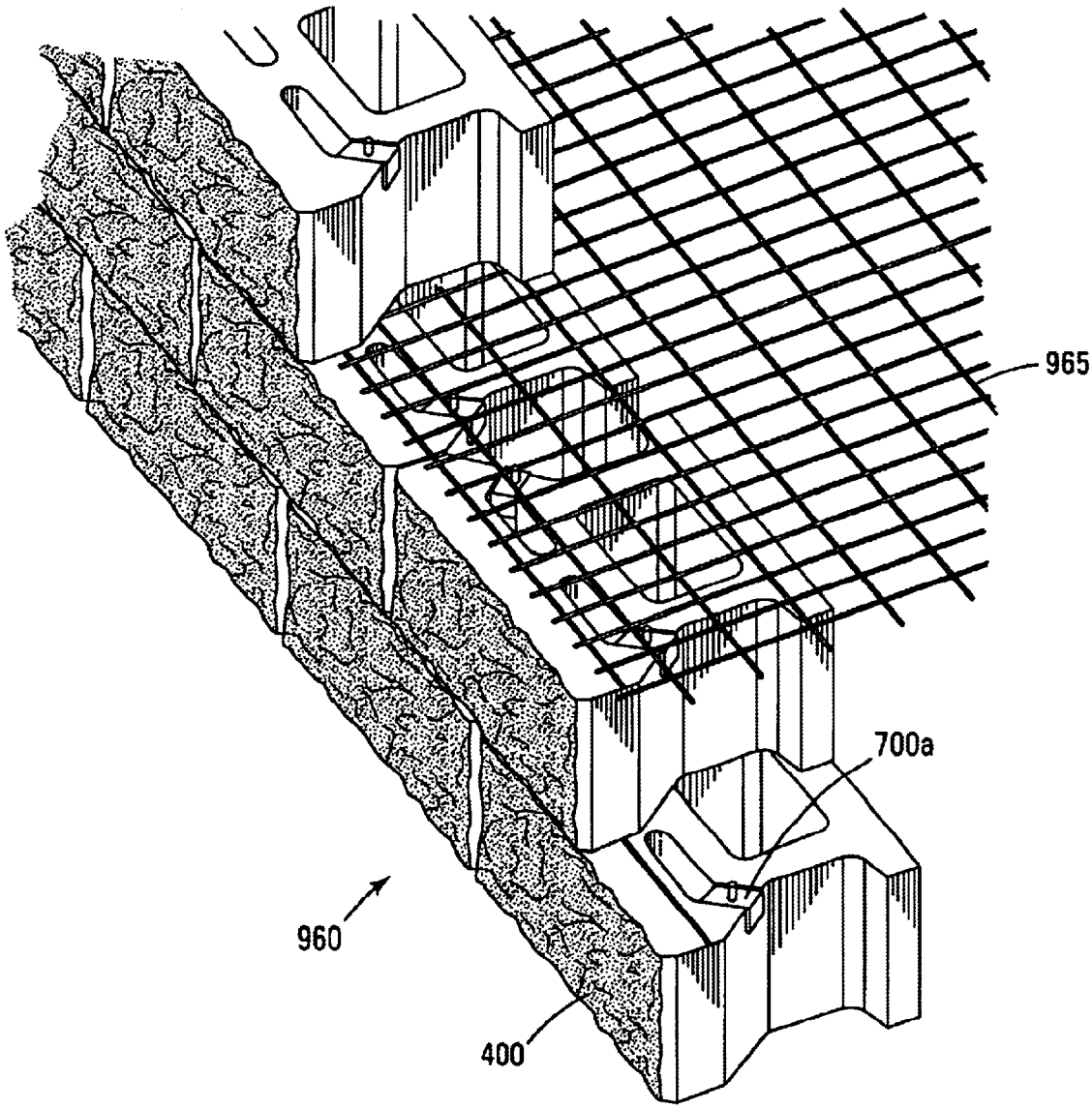
FIG. 13 is a partial perspective view of a wall of the blocks of FIG. 9A with connector and geosynthetic fabric in place.

FIG. 13 shows a cut-away view of wall 960 showing geosynthetic fabric 965 laid over connectors 700*a* in position in recesses 414*a* and 415*a* of block 400. In this case, the connectors not only help secure the geosynthetic fabric, but they also add to the stability of the wall, since the pin elements on the lower course extend into cavities 418 and 419 on the upper course. Geosynthetic fabric 965 extends behind the retaining wall so that it can tie into the earth behind the wall, thus increasing the structural strength of the wall.

Geofabrics, such as shown in FIG. 13, are generally more flexible than materials formed from flat polymeric sheets of high density polyethylene (HDPE). These relatively rigid geogrids are commercially available under the trade designation "TENSAR". Holes are formed in the HDPE sheets and then the sheet is drawn or pulled to orient the polymer and increase the modulus. HDPE geogrids are not readily compatible with many prior art wall systems because HDPE geogrids have a relatively thick transverse bar, which will cause the next layer of blocks to be out of level, unless shimming or other means are utilized to compensate for this tendency. The present invention allows the use of HDPE geogrids without shimming because the transverse bar of the geogrid is laid into the recessed areas of adjacent blocks. A connector can then placed over the geogrid, connecting it to the block. The geogrid will then lie flat and the blocks in an upper course will remain level.

Succeeding courses of block are then placed above the reinforcement material. Enhancing the connection strength of the reinforcement material to the block is particularly desirable where the reinforcement material is placed close to the top of a wall. Here the confining pressure of the blocks above the reinforcement material is reduced. In a preferred method of forming a wall with the blocks of this invention, connectors 700 are used (with or without reinforcement material) only in the upper section of a wall to provide optimal connection strength. They are not necessary lower in the wall where there is a higher load on the block resulting in higher connection strength.

Blocks of this invention are typically manufactured of concrete and cast in a high-speed masonry block machine. For example, cavities 418 and 419 and core 413 of block 400 all are formed using mold core elements. For ease in manufacturing, these blocks typically are made with the top surface facing up. In this way the recessed area can be easily formed by a stripper shoe head of the mold. An advantage of the present design is that it requires a relatively simple mold. In addition, because the present design does not require the formation of pin receiving holes, it is easier to produce since pin receiving holes need to be kept clear of aggregates and concrete crumbs. Typically, blocks are formed as mirror image pairs joined at front face 404 which are then subsequently split using a block splitter, as known in the art, to provide a rough appearing front surface on the split blocks. The front face may be treated further to chamfer the edges or to give it any other desired appearance. Alternatively, other methods may be utilized to form a variety of front face surface appearances. Such methods are well known in the art.

Although particular embodiments have been disclosed herein in detail, this has been done for purposes of illustration only, and is not intended to be limiting with respect to the scope of the appended claims, which follow. In particular, it is contemplated by the inventor that various substitutions, alterations, and modifications may be made to the invention without departing from the spirit and scope of the invention as defined by the claims. For instance, the choice of materials or variations in the shape or angles at which some of the surfaces intersect are believed to be a matter of routine for a person of ordinary skill in the art with knowledge of the embodiments disclosed herein.

What is claimed is:

1. A wall block connection system comprising:

a plurality of wall blocks, each wall block having a top surface, a bottom surface opposed to the top surface, first and second opposing side surfaces, a front face, and a rear face, the front and rear faces, top and bottom surfaces and side surfaces defining a block body, the block body including a head portion including the front face, a rear portion including the rear face, and first and second neck portions defining a core between the head and rear portions adjacent the rear portion, the head portion having at least one cavity defining a first web portion between the cavity and the first side surface and a second web portion between the cavity and the second side surface; and a plurality of channel shaped connectors, each connector having first and second side segments connected by a bridge segment, the bridge segment having a pin element extending therefrom and being sized such that during construction of a wall, the first and second side segments straddle a web portion of the wall block.

2. The connection system of claim 1 wherein each wall block further comprises a partition dividing the cavity into first and second cavities.

3. The connection system of claim 1 wherein the pin element defines a longitudinal axis and wherein a cross-section through the pin element perpendicular to the longitudinal axis is circular.

4. A retaining wall having at least a first lower course of blocks and a second upper course of blocks, the retaining wall comprising:

a plurality of wall blocks, each wall block having a top surface, a bottom surface opposed to the top surface, first and second opposing side surfaces, a front face, and a rear face, the front and rear faces, top and bottom surfaces and side surfaces defining a block body, the block body including a head portion including the front face, a rear portion including the rear face, and first and second neck portions defining a core between the head and rear portions adjacent the rear portion, the head portion having at least one cavity defining a first web portion between the cavity and the first side surface and a second web portion between the cavity and the second side surface; and a plurality of channel shaped connectors, each connector having first and second side segments connected by a bridge segment, the bridge segment having a pin element extending therefrom and being sized such that the first and second side segments straddle a web portion of a wall block in the lower course of wall blocks when the bridge segment is accommodated within a recessed region of the web portion so that the pin element extends upwardly into a cavity of a wall block in the upper course to thereby stabilize the relative positions of the wall blocks in the upper and lower courses.

5. The retaining wall of claim 4 wherein each wall block further comprises a partition dividing the cavity into first and second cavities.

6. The retaining wall of claim 4 wherein the pin element defines a longitudinal axis and wherein a cross-section through the pin element perpendicular to the longitudinal axis is circular.

7. A method of making a retaining wall having at least a first lower course of wall blocks and a second upper course of wall blocks comprising:

a plurality of wall blocks, each wall block having a top surface, a bottom surface opposed to the top surface, first and second opposing side surfaces, a front face, and a rear face, the front and rear faces, top and bottom surfaces and side surfaces defining a block body, the block body including a head portion including the front face, a rear portion including the rear face, and first and second neck portions defining a core between the head and rear portions adjacent the rear portion, the head portion having at least one cavity defining a first web portion between the cavity and the first side surface and a second web portion between the cavity and the second side surface;

providing a plurality of channel shaped connectors, each connector having first and second side segments connected by a bridge segment, the bridge segment having a pin element extending therefrom;

placing the wall blocks to form the first lower course of wall blocks;

positioning the connectors on the wall blocks in the first course such that the first and second side segments of each connector straddle the first and second web portions and the bridge portion is accommodated within a recessed region of the first and second web portions and the pin element extends upwardly; and placing the wall blocks over the first course of wall blocks to form the second course of wall blocks, the second course of wall blocks being positioned such that the cavity of each wall block in the second course of wall blocks receives an upwardly extending pin element.

* * * * *